US011305203B2

(12) United States Patent
Weinshanker et al.

(10) Patent No.: US 11,305,203 B2
(45) Date of Patent: Apr. 19, 2022

(54) CRAFT MODEL

(71) Applicant: National Entertainment Collectibles Association, Inc., Hillside, NJ (US)

(72) Inventors: Joel Weinshanker, Hillside, NJ (US); Francis A. Kozik, San Francisco, CA (US)

(73) Assignee: National Entertainment Collectibles Association, Inc., Hillside, NJ (US)

( * ) Notice: Subject to any disclaimer, the term of this patent is extended or adjusted under 35 U.S.C. 154(b) by 0 days.

(21) Appl. No.: 16/792,092

(22) Filed: Feb. 14, 2020

(65) Prior Publication Data

US 2020/0261813 A1 Aug. 20, 2020

Related U.S. Application Data

(60) Provisional application No. 62/806,234, filed on Feb. 15, 2019.

(51) Int. Cl.
*A63H 3/08* (2006.01)
*A63H 3/16* (2006.01)

(52) U.S. Cl.
CPC ..... *A63H 3/08* (2013.01); *A63H 3/16* (2013.01)

(58) Field of Classification Search
CPC ..... A63H 33/00; A63H 33/04; A63H 33/16; A63H 33/38; A63H 3/16; A63H 3/08; E04B 1/00; E04B 1/34384; E04B 1/34357

(Continued)

(56) References Cited

U.S. PATENT DOCUMENTS 8,783,548 B2 * 7/2014 Billen ..... B65D 5/425 229/116.4
2012/0309258 A1 12/2012 Hawthorne (Continued)

FOREIGN PATENT DOCUMENTS

| | | | |
|---|---|---|---|
| JP | 3213821 | U | 12/2017 |
| WO | 2006/043067 | A2 | 4/2006 |
| WO | 2017/095064 | A1 | 6/2017 |

OTHER PUBLICATIONS

International Search Report of the International Searching Authority dated Jun. 26, 2020, issued in connection with International Application No. PCT/US20/18434 (5 pages).

(Continued)

*Primary Examiner* — Kien T Nguyen
(74) *Attorney, Agent, or Firm* — McCarter & English, LLP

(57) ABSTRACT

A three-dimensional craft model including a head and body is provided. More specifically, the craft model includes a two-dimensional body cutout and a two-dimensional body cutout. The cutouts can be formed into three-dimensional head and body objects by folding portions of the cutouts about fold lines and the three-dimensional objects can be held in place using one or more of securing tabs, reciprocal slots, and locking tabs. Also provided herein is a method for forming the three-dimensional craft figure, including the steps of folding portions of the body cutout across fold lines, locking one or more locking tabs on the body cutout to form the body object, folding one or more portions of the head cutout across fold lines, inserting one or more securing tabs through corresponding slots in the head cutout to form the body object, and attaching the head object to the body object.

21 Claims, 14 Drawing Sheets

(58) Field of Classification Search
USPC ..... 446/85, 108, 487–488
See application file for complete search history.

(56) References Cited

U.S. PATENT DOCUMENTS

| | | | | |
|---|---|---|---|---|
| 2016/0008726 | A1 | 1/2016 | Morris et al. | |
| 2016/0129362 | A1* | 5/2016 | Zebersky | A63H 33/16 446/488 |
| 2016/0339352 | A1 | 11/2016 | Liu | |
| 2020/0306656 | A1* | 10/2020 | Song | A63H 3/16 |

OTHER PUBLICATIONS

Written Opinion of the International Searching Authority dated Jun. 26, 2020, issued in connection with International Application No. PCT/US20/18434 (7 pages).
Invitation to Pay Additional Fees and, Where Applicable, Protest Fee from the International Searching Authority dated Apr. 9, 2020, issued in connection with International Application No. PCT/US20/18434 (2 pages).

* cited by examiner

CRAFT MODEL

CROSS-REFERENCE TO RELATED APPLICATIONS

This application claims priority to U.S. Provisional Patent Application No. 62/806,234, filed Feb. 15, 2019, the entire disclosure of which is expressly incorporated herein by reference.

BACKGROUND

Field of the Disclosure

The present disclosure relates generally to a craft model. More specifically, the present disclosure relates to a craft model defined by a three-dimensional head and a three-dimensional body that are assembled from two-dimensional cutouts by a plurality of foldable portions.

Related Art

In the assembly craft model field, paper or cardboard sheets are used to fabricate objects. Where the material is often frail and can be easily damaged/destroyed by water/humidity, etc., the use of glue can often get messy and result in a misaligned assembly, and the designs themselves can be relatively elementary and dreary.

In view of the foregoing, it is desirable to provide a craft model which is sturdy, captivating in appearance, and simple to construct.

SUMMARY

The present disclosure relates generally to an assembly craft model. The craft model is assembled from a two-dimensional body cutout and a two-dimensional head cutout. The body cutout and the head cutout each include a plurality of securing tabs, slits, and fold lines. Additionally, the head cutout includes a body attachment opening and the body cutout includes locking tabs. The body cutout and the head cutout can each be folded along fold lines to assemble a three-dimensional body and a three-dimensional head, respectively, by inserting securing tabs into slits. The body attachment hole can then used to attach the three-dimensional head to the three-dimensional body to form the craft model.

BRIEF DESCRIPTION OF THE DRAWINGS

The foregoing features of the disclosure will be apparent from the following Detailed Description, taken in connection with the accompanying drawings, in which.

DETAILED DESCRIPTION

The present disclosure relates to a plastic craft model having a three-dimensional head and a three-dimensional body.

Figure 1:
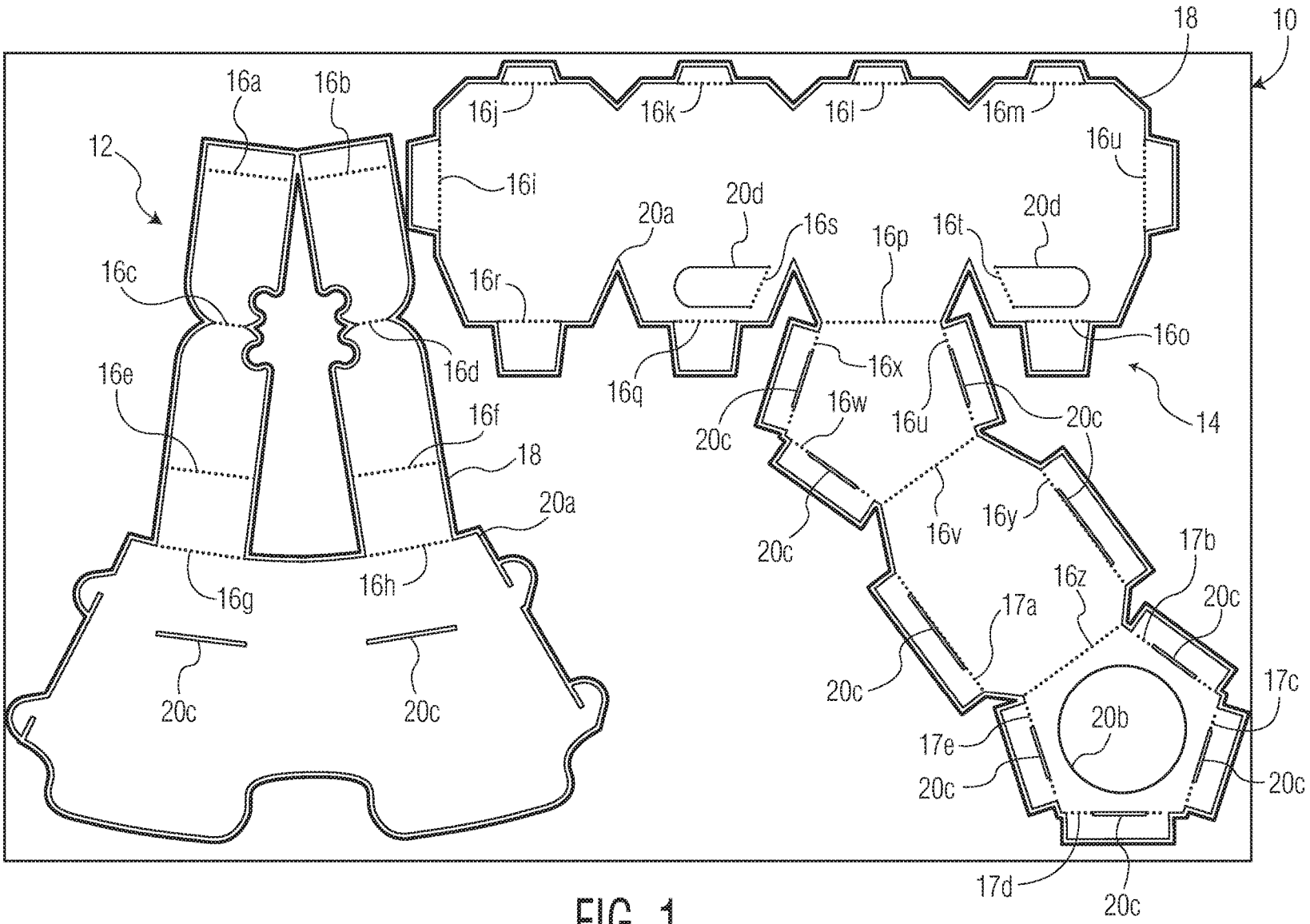
FIG. 1 is illustration showing a sheet with a body cutout and a head cutout for a craft model of the present disclosure.

FIG. 1 is an illustration showing a sheet 10 for a craft model of the present disclosure. The sheet 10 includes a body cutout 12 and a head cutout 14. The body cutout 12 and head cutout 14 can be separated from the sheet 10 along score lines or die cut lines that determine shape of the body and the head, respectively. The body cutout 12 and the head cutout 14 each include one or more fold lines 16 (each fold line is labeled as one of 16*a*-16*z* or 17*a*-17*e*), bleed lines 18, and die cut lines 20 (each die cut line is labeled as one of 20*a*, 20*b*, 20*c*, and 20*d*). The fold lines 16 indicate locations where a fold is used to assemble the two-dimensional cutout 12, 14 into a three-dimensional object. Both the body cutout 12 and the head cutout 14 can be made from a single cutout that is separated from the sheet 10 and folded into the three-dimensional object or from two cutouts that are separated from the sheet 10 and folded into the three-dimensional object. As shown in FIG. 1, the head cutout 14 can include a first side wall having first, second, third, and fourth panels, and a top wall that is connected to one of the first, second, third, or fourth panels. The top wall can also be connected to a second side wall including one or more panels, and the top wall can also be connected to a bottom wall having a body attachment aperture 40, discussed below. The body attachment aperture can be round as shown. The first and second side walls, including their respective panels, can form a perimeter of the three-dimensional head object (see, e.g., FIG. 4B).

The die cut lines 20 indicate where the cutouts 12, 14 are to be cut or separated from the sheet 10, and can include perimeter cut lines 20*a*, internal cut line 20*b*, slit cut lines 20*c*, and tab cut lines 20*d*. The bleed lines 18 indicate where a design or artwork may run past the die cut lines 20, as those skilled in the art would understand, to ensure that a misalignment of a perimeter die cut line 20*a* does not result in a white edge on the cutout. It should be understood that the bleed lines 18 and the die cut lines 20 shown are for reference, and are not necessarily printed on the sheet 10.

The cutouts 12, 14 may be completely cut along the die cut lines 20, or partially cut along the die cut lines 20. For example, the cutouts 12, 14 can be perforated along the die cut lines 20, thus allowing the user to easily remove the cutouts 12, 14 from the sheet 10. Those skilled in the art would understand that other methods to partially cut the cutouts 12, 14 from the sheet can be used to allow the user to easily separate the cutouts 12, 14. Thus, the die cut lines 20 could be cut lines with one or more small connections that can be easily broken by the user. Alternatively, cutouts 12, 14 can be completely cut along the die cut lines 20 in some places, and partially cut along the die cut lines in other places. For example, the perimeter cut lines 20*a* can be cut partially, while the internal cut line 20*b*, the slit cut lines 20*c*, and the tab cut lines 20*d* are cut completely. The cutouts 12, 14 can be cut using any suitable cutting method. Alternatively, a user could cut the body and head cutouts 12, 14 from the sheet 10 using a scissor or the like.

The sheet 10 can be made out of any suitable material, including, but not limited to, plastic, cardboard, etc. Further, the sheet 10 can be of any suitable size or thickness.

Figure 2:
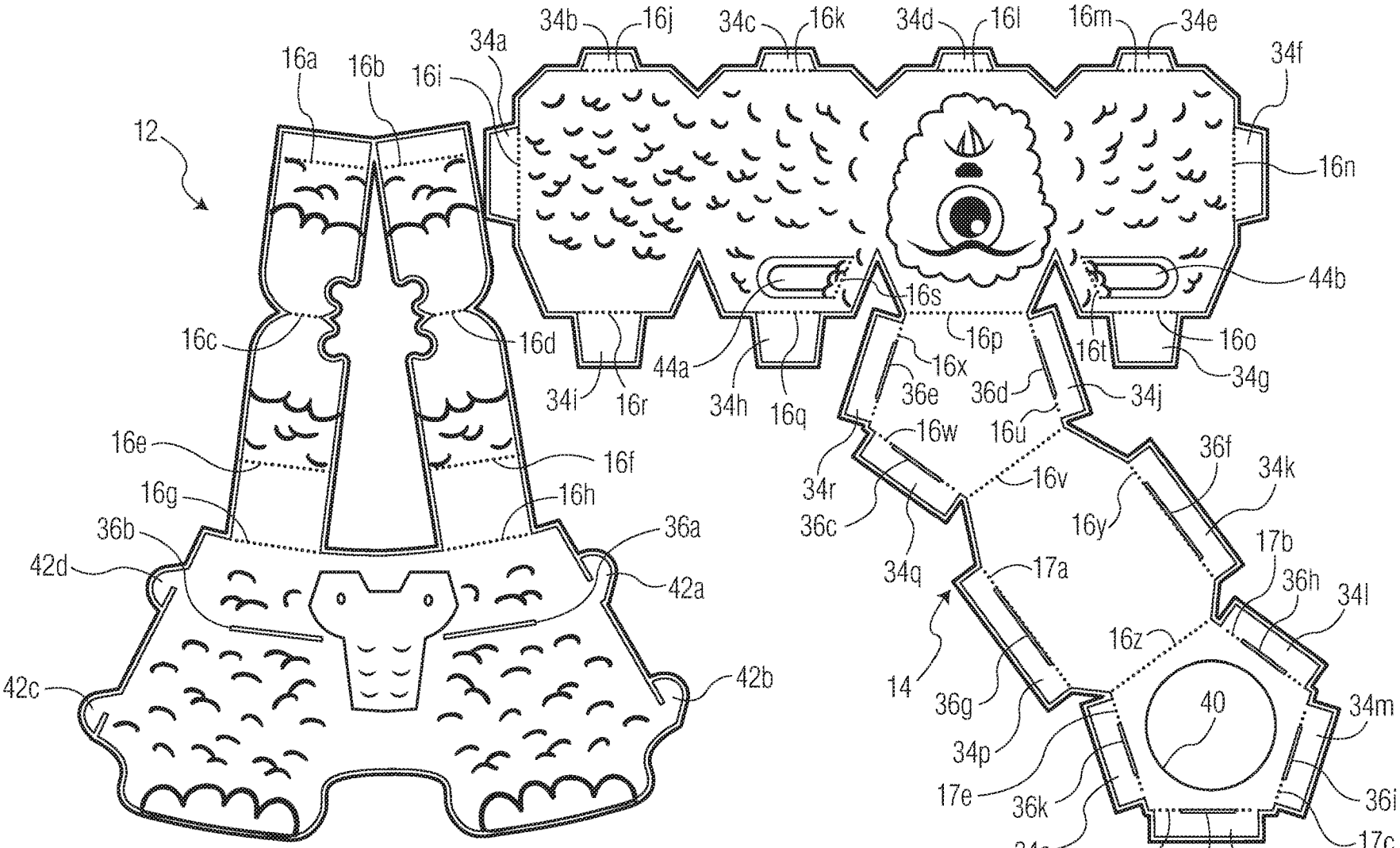
FIG. 2 is an illustration showing a body cutout and a head cutout of FIG. 1, with a design thereon, removed from the sheet.

FIG. 2 is an illustration showing the body cutout 12 and the head cutout 14 separated from the sheet 10. Specifically, FIG. 2 shows cutouts 12 and 14 printed with a design or artwork. The design in FIG. 2 includes a "cyclops" monster. However, any design can be used, such as, for example, past or present pop culture characters, popular characters, motifs of any sort, people, action figures, etc. This allows the cutouts 12 and 14 to be used for different designs. The design can be printed with one or more colors 32. The cutouts 12, 14 further include a plurality of securing tabs 34 (each tab labeled as one of 34*a*-34*r*), slits 36 (each slit labeled as one of 36*a*-36*k*), fold lines 16 (each fold line labeled as one of 16*a*-16*z* or 17*a*-17*e*), and tabs 44*a* and 44*b*.

In additional, the head cutout 14 includes a body attachment aperture 40, for connecting a three-dimensional head formed by the head cutout 14 to a three-dimensional body formed by the body cutout 12. The body cutout 12 includes locking tabs 42 (each locking tab is represented by one of 42*a*-44*d* to form the body cutout 12 into a three-dimensional body). The locking tabs 42 each comprise a generally semi-circular tab that is partially detached from the body cutout 12. Locking tabs 42*a* and 42*b* are flipped mirror images of locking tabs 42*c* and 42*d*, so that locking tabs 42*a* and 42*b* can align and lock with locking tabs 42*d* and 42*c*, respectively, when the body cutout 12 is formed into the three dimensional body. The detached portion of each tab slides over the attached portion of the corresponding tab to retain the tabs together and to retain the body in a three dimensional shape having an upper edge and a generally frustoconical shape.

The cutouts 12, 14 can be folded along the fold lines 16 to assemble the two-dimensional cutouts 12, 14 into the three-dimensional objects. The securing tabs 34 can be inserted into the slits 36 to form and retain the shape of the head as a three-dimensional object. Specifically, the securing tabs 34, slits 36, and fold lines 16 on the body cutout 12 are used to form a three-dimensional body of the craft model, and the securing tabs 34, slits 36, and fold lines 16 on the head cutout 14 are used to form a three-dimensional head of the craft model. The three-dimensional head can be attached to the three-dimensional body by resting the head, at the attachment aperture 40, on the body with a pressure fit, securing tabs/slits, a twist/lock mechanism, or any other appropriate securing method. Other fastening mechanisms can be used in addition to, or instead of the securing tabs/slits 34, 36, the locking tabs 42, and the body attachment hole 40.

Figure 3:
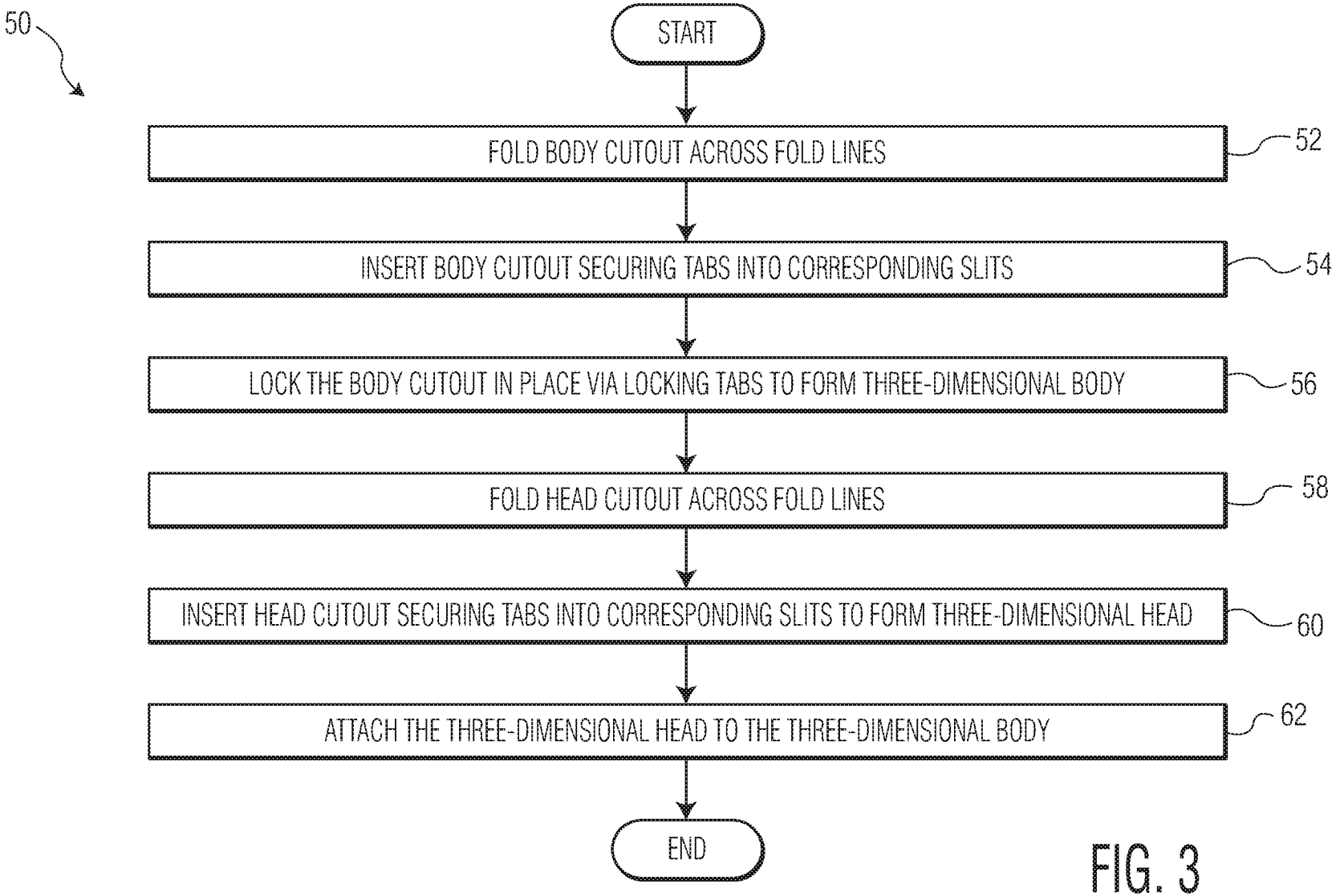
FIG. 3 is a flowchart illustrating a method for assembling the body cutout and the head cutout to create a three-dimensional craft model of the present disclosure.

FIG. 3 is a flowchart illustrating a method 50 for assembling the body cutout 12 and head cutout 14 into the three-dimensional craft model. In step 52, the body cutout 12 is folded across the fold lines 16. In step 54, the securing tabs 34 of the body cutout 12 are inserted into their corresponding slits 36. In step 56, body cutout 12 is locked in place via the locking tabs 42 to form the three-dimensional body. In step 58, the heat cutout 14 is folded across the fold lines 16. In step 60, the securing tabs 34 of the heat cutout 14 are inserted into their corresponding slits 36 to form the three-dimensional head. In step 62, the three-dimensional head is attached to the three-dimensional body.

Figure 4A:
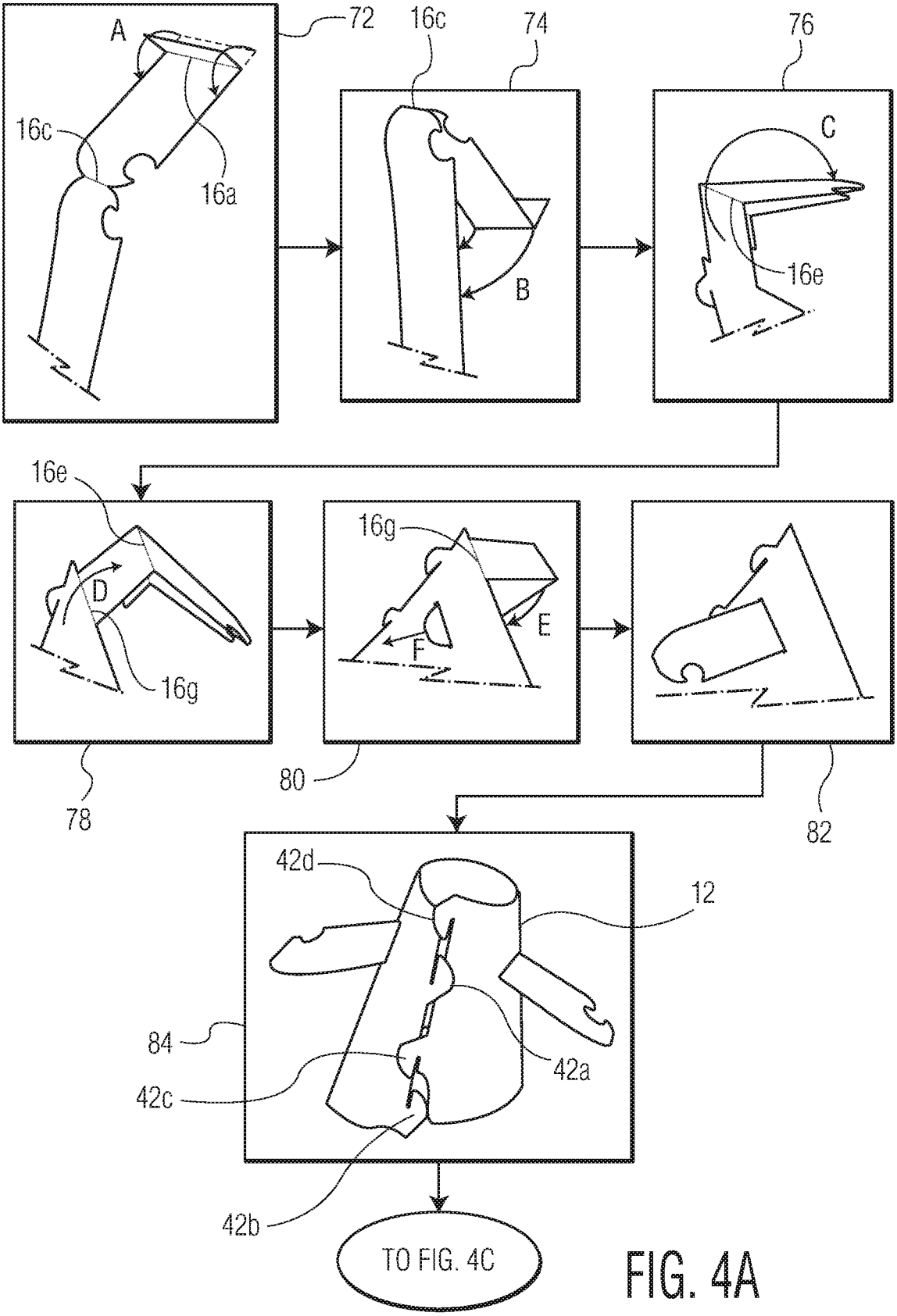
FIGS. 4A-4D are illustrations visually showing the steps of the method of FIG. 3.
Figure 4B:
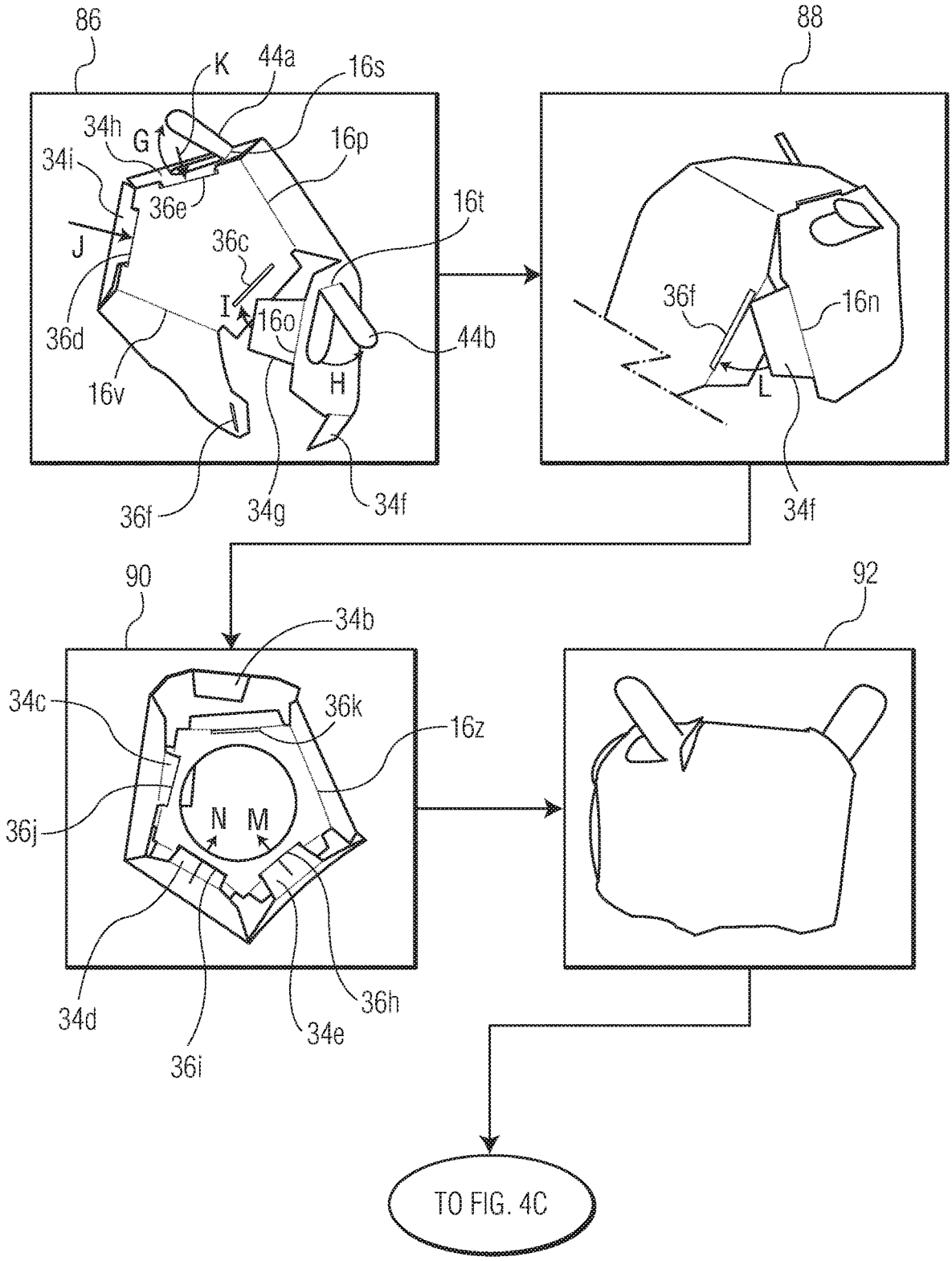
Figure 4C:
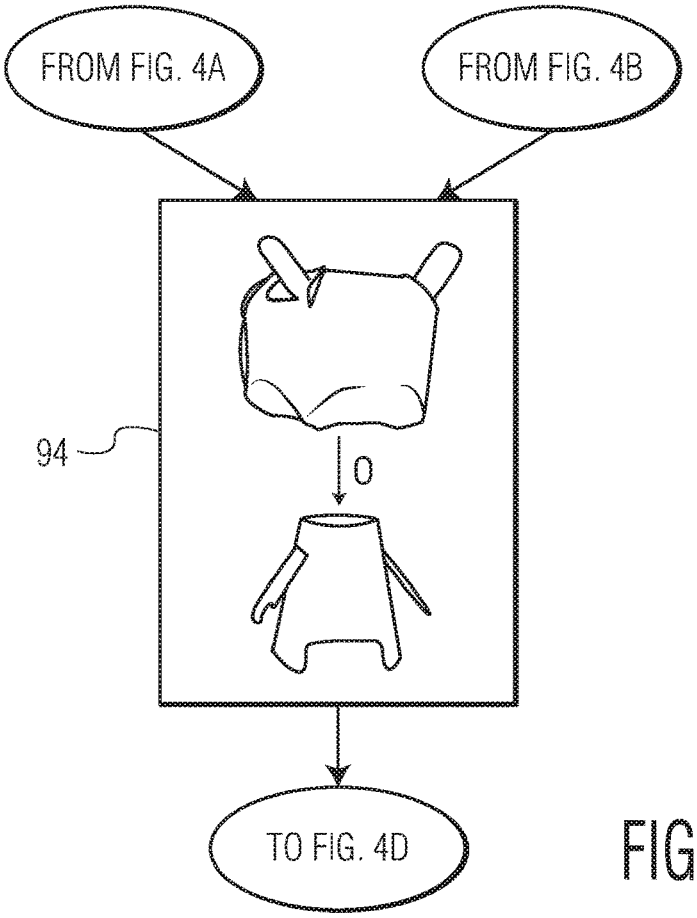

FIGS. 4A-4C are illustrations visually showing the steps of method 50. FIG. 4A shows the process of steps 52-56. Specifically, FIG. 4A shows a first fold in the direction of arrow A across fold line 16*a* in the body cutout in panel 72, a second fold in the direction of arrow B across fold line 16*c* in panel 74, a third fold in the direction of arrow C across fold line 16*e* in panel 76, and a fourth fold in the direction of arrow D across fold line 16*g* to form a folded element in panel 78. Next, in panel 80, the folded element is inserted in the direction of arrow E into and pulled through slit 36*b* in the direction of arrow F. An arm formed by this process is shown in panel 82. It should be understood that this process is repeated using folding lines 16*b*, 16*d*, 16*f*, 16*h*, and slit 36*a* to form a second arm from the body cutout 12. Further, FIG. 4A shows body cutout formed as a three-dimensional body held in position by locking tabs 42*a*-42*d* in panel 84. Specifically, locking tab 42*a* is aligned and locked with locking tab 42*d*, and locking tab 42*b* is aligned and locked with locking tab 42*c* to hold the three-dimensional body in position.

FIG. 4B shows the process of steps 58 and 60. Specifically, in panel 86, securing tab 34*g* is folded across folding line 16*o* and inserted in the direction of arrow I into slit 36*c*, securing tab 34*i* is folded across folding line 16*r* (not shown) an inserted in the direction of arrow J into slit 36*d*, and securing tab 34*h* is folded across folding line 16*q* (now shown) and inserted in the direction of arrow K into slit 36*e*. In addition, panel 86 shows tab 44*a* folded in the direction of arrow G across folding line 16*s* and lifted upright, and tab 44*b* folded in the direction of arrow H across folding line 16*t* and lifted upright. In panel 88, securing tab 34*f* is folded across folding line 16*n* and inserted in the direction of arrow L into slit 36*f*. In panel 90, securing tab 34*e* is inserted in the direction of arrow M into slit 36*h*, securing tab 34*d* is inserted in the direction of arrow N into slit 36*i*, securing tab 34*c* is inserted into slit 36*j*, and securing tab 34*b* is inserted into slit 36*k*. In panel 92, a three-dimensional head is shown formed from the described process.

Figure 4D:
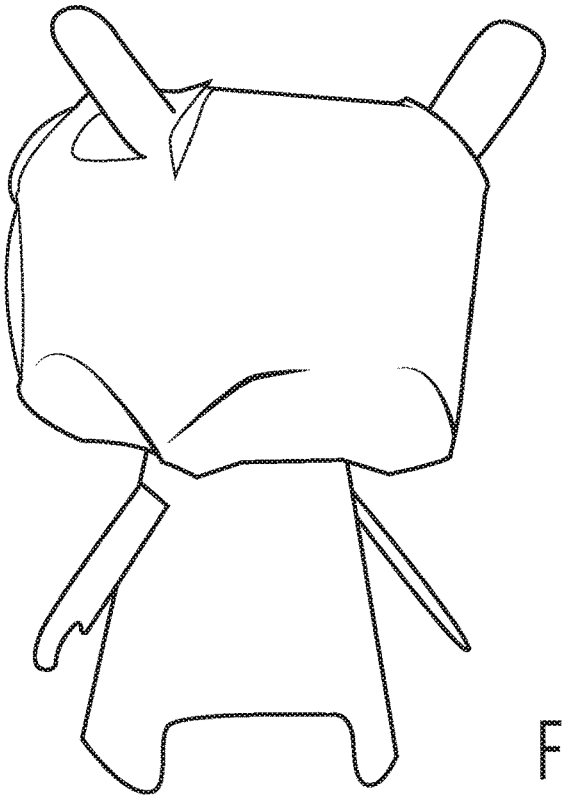

FIG. 4C shows the process of step 62. Specifically, FIG. 4C shows attaching in the direction of arrow O the three-dimensional head to the three-dimensional body in panel 94. FIG. 4D is an illustration showing a rear perspective view of the assembled three-dimensional craft model. Those skilled in the art would understand that the order of the steps in method 50 can be altered.

Figure 5B:
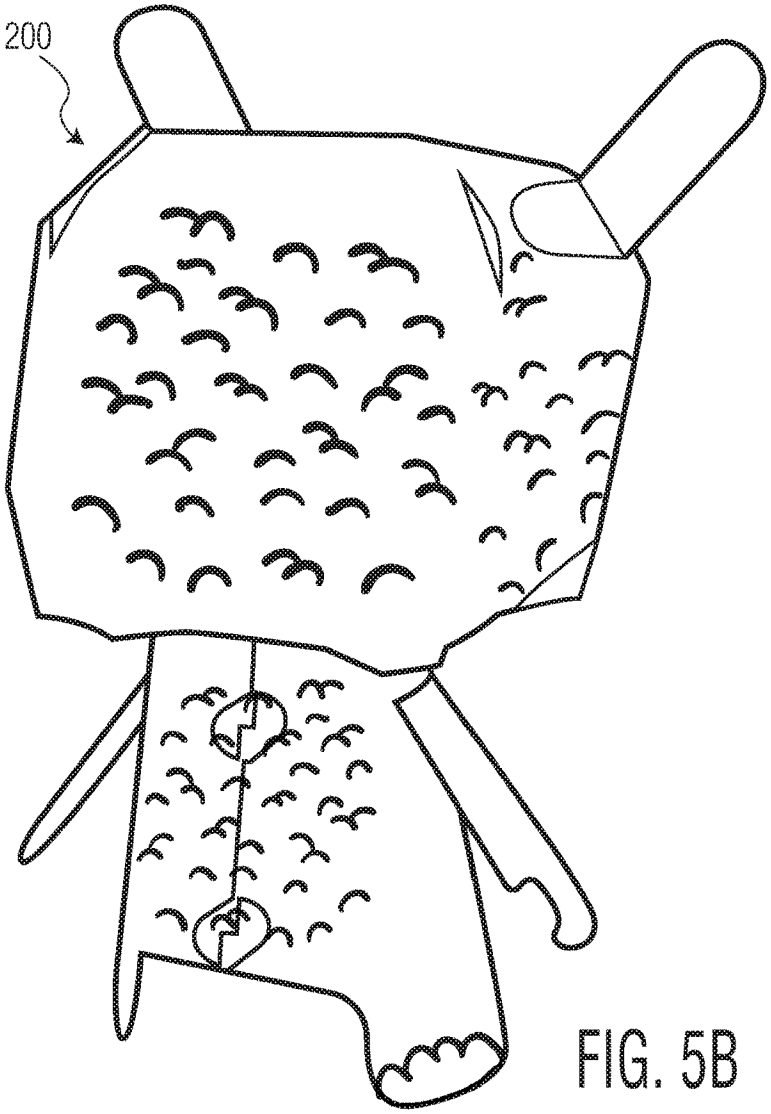
FIGS. 5A and 5B are illustrations showing an assembled three-dimensional craft model having a head and body of the present disclosure.
Figure 5A:
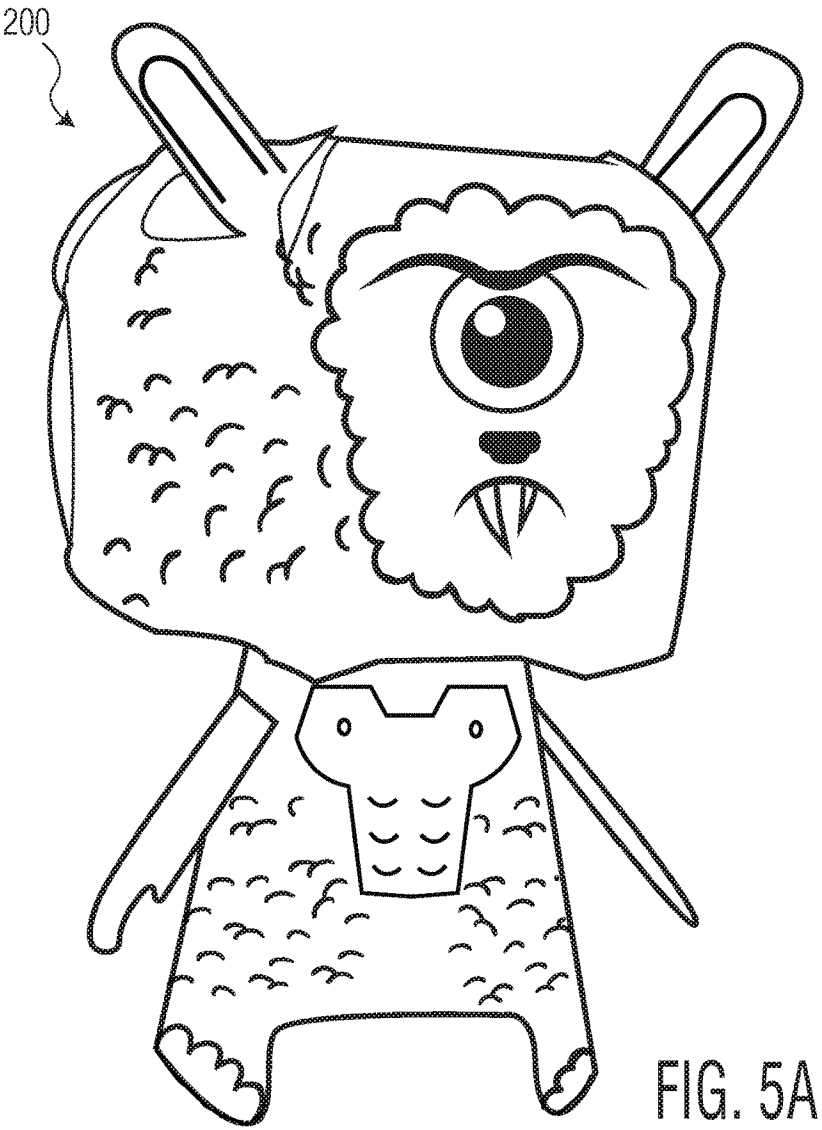

FIGS. 5A and 5B are illustrations showing an assembled three-dimensional craft model 200 bearing a design. Specifically, FIG. 5A shows a front perspective view of the assembled craft model 200 and FIG. 5B shows a back perspective view of the assembled craft model 200.

Figure 6:
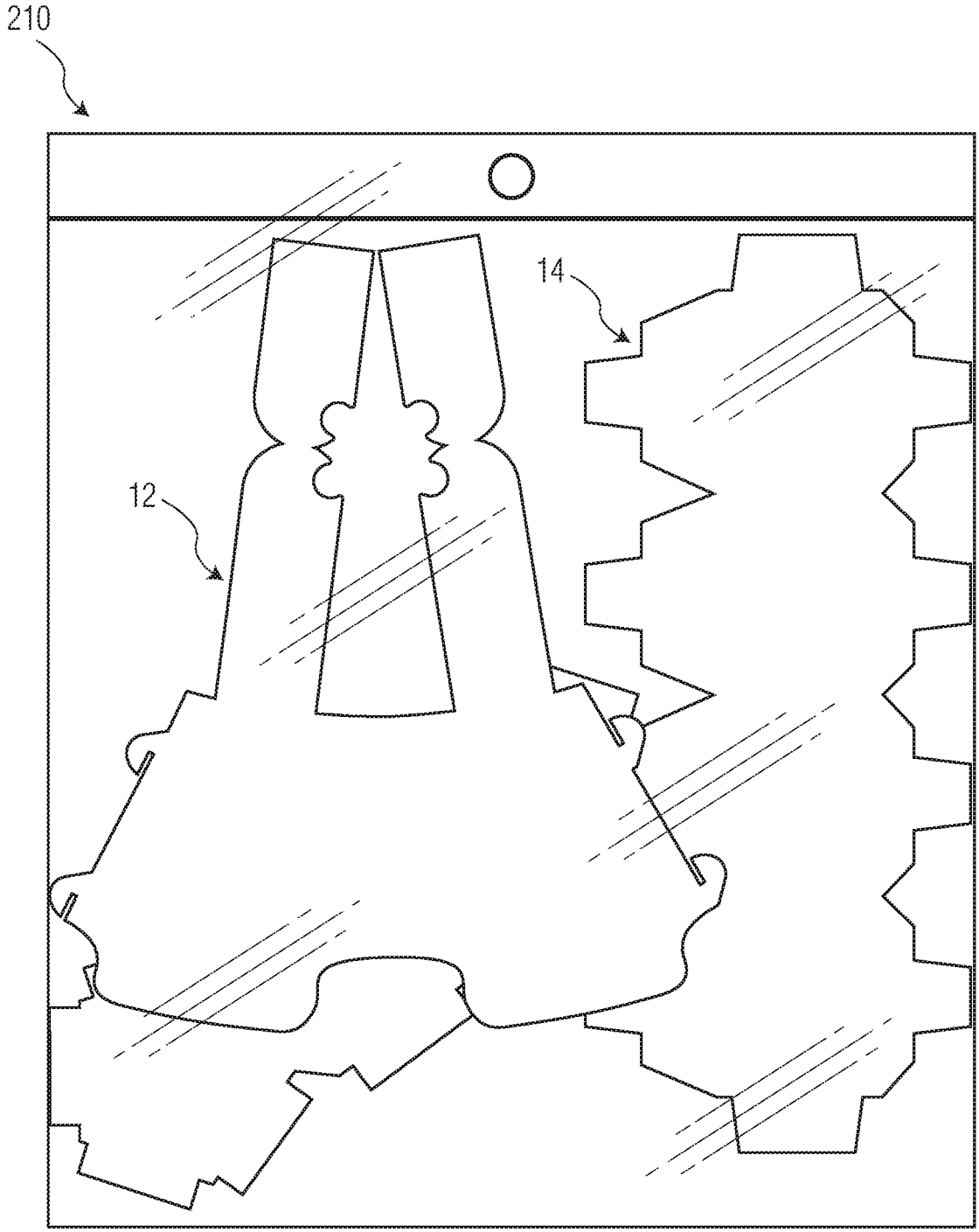
FIG. 6 is an illustration showing a package containing a body cutout and a head cutout of the present disclosure.

FIG. 6 is an illustration showing a package 210 containing the body cutout 12 and the head cutout 14. The package can include an aperture 212 for hanging the package 210 on a display. The package can be generally transparent to allow a person to view the design before purchase. As seen, the body cutout 12 and the head cutout 14 have been precut from a sheet 10 and are ready to be assembled.

Figure 7A:
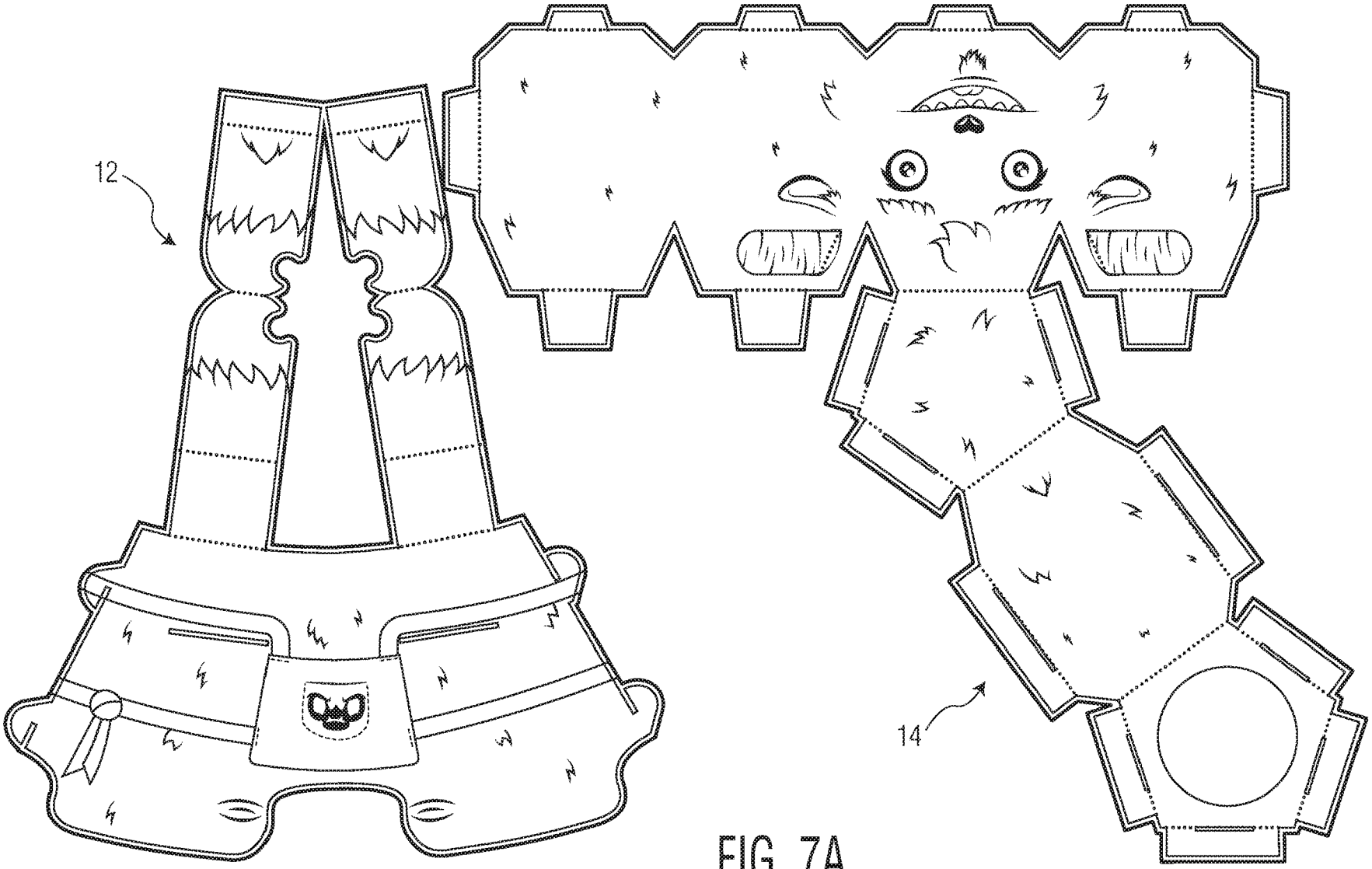
FIGS. 7A, 7B and 7C, and FIGS. 8A, 8B and 8C, and FIGS. 9A, 9B and 9C are illustrations showing a body cutout and a head cutout of craft models with designs thereon, along with the assembled three-dimensional craft models formed by the body cutouts and the head cutouts.
Figure 7C:
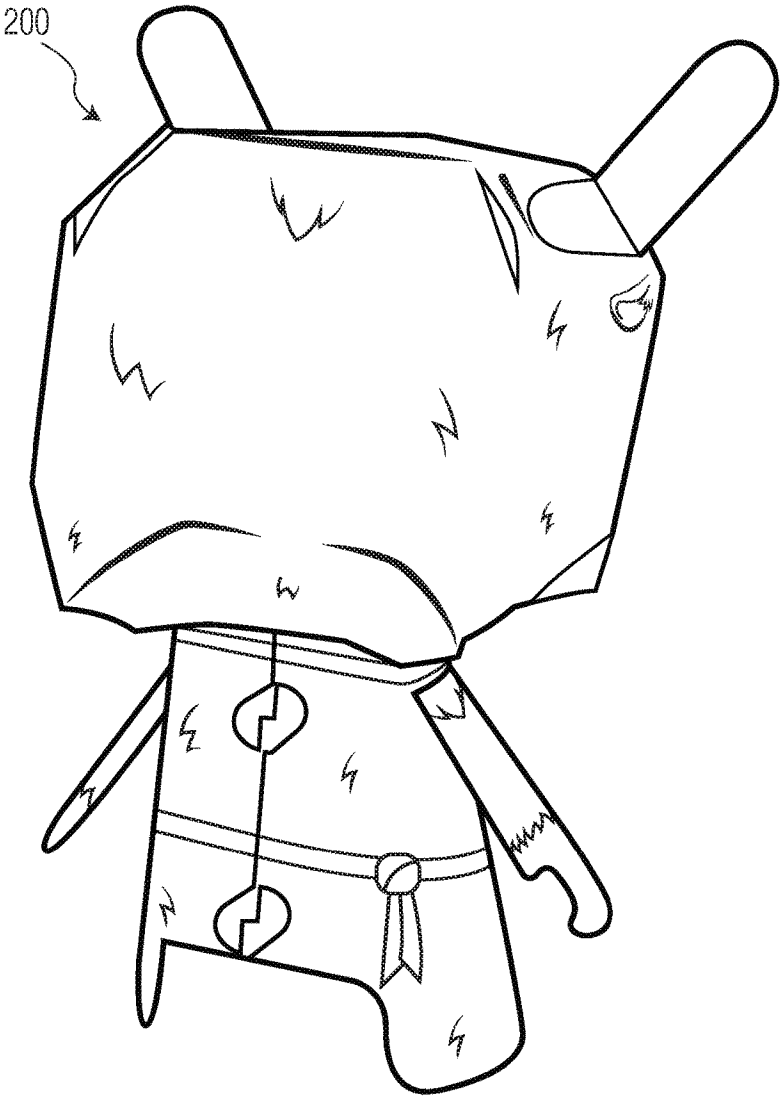
Figure 7B:
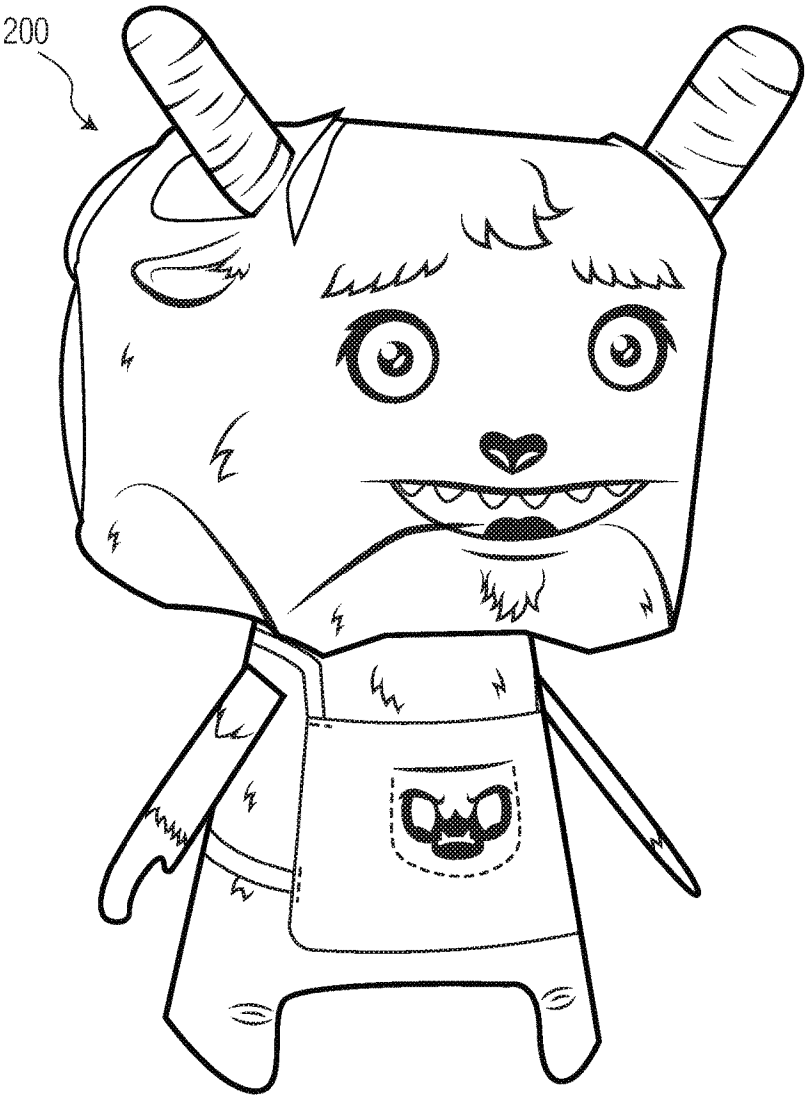

FIGS. 7A-7C are illustrations a craft model bearing another design. Specifically, FIG. 7A shows a body cutout 12 and a head cutout 14 of the craft model design, FIG. 7B shows a front perspective view of the assembled three-dimensional craft model 200 formed by the body cutout 12 and the head cutout 14, and FIG. 7C shows a rear perspective view of the assembled three-dimensional craft model 200.

Figure 8A:
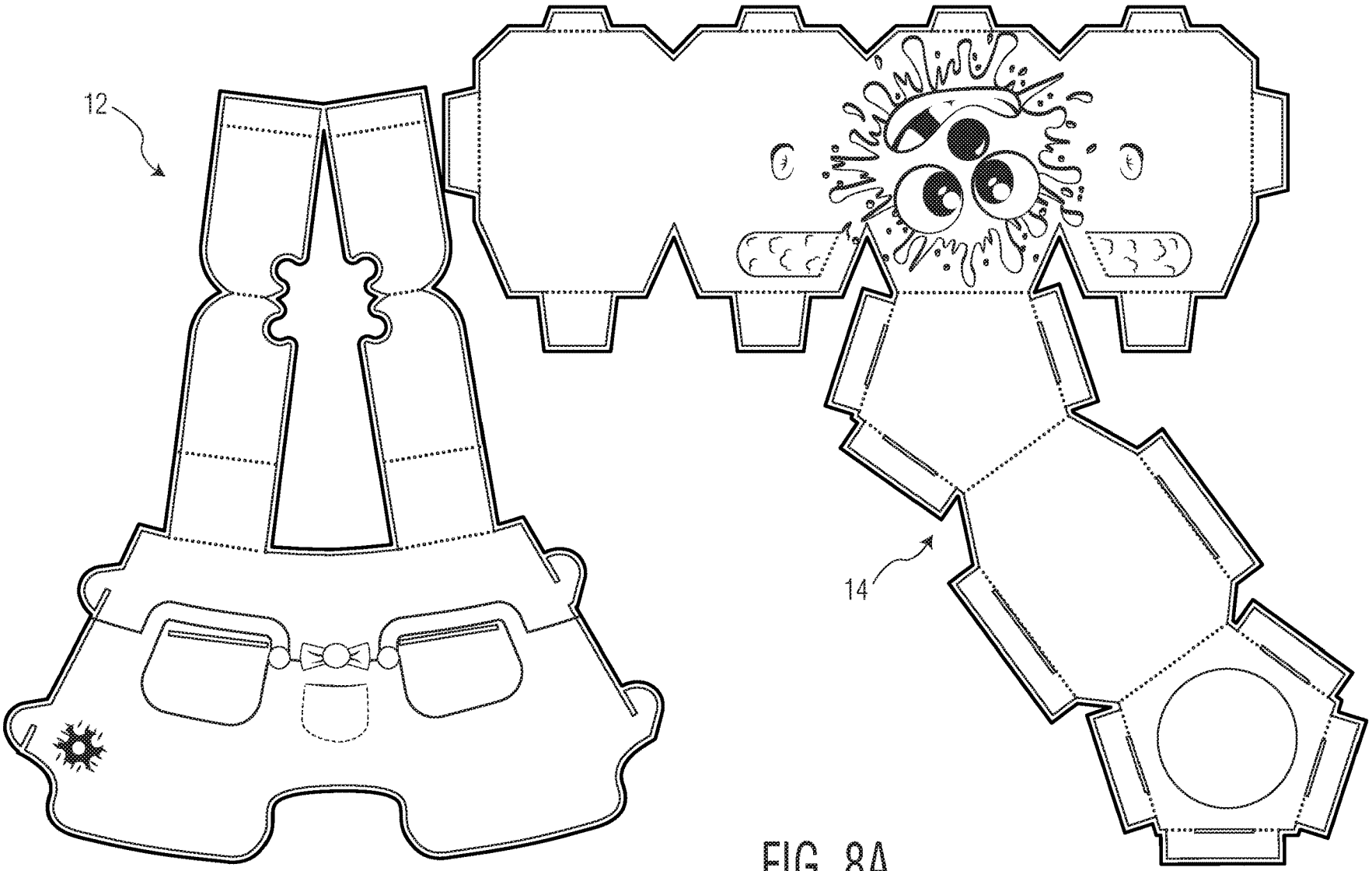
Figure 8C:
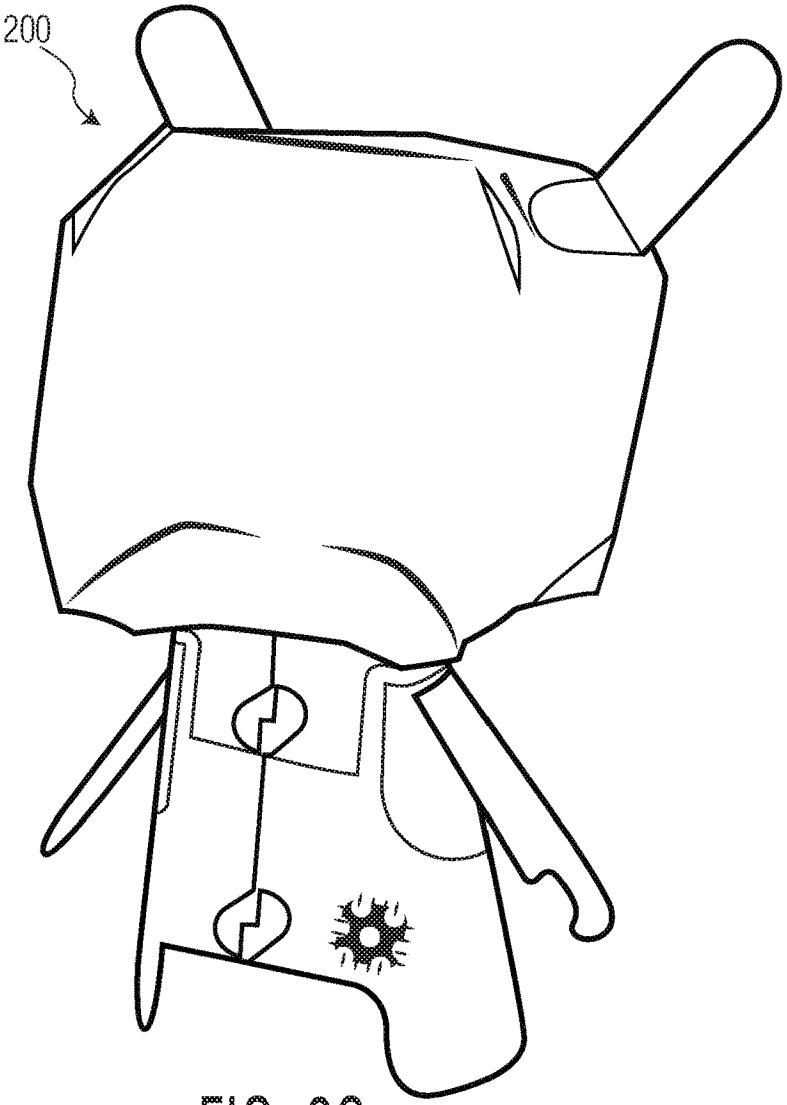
Figure 8B:
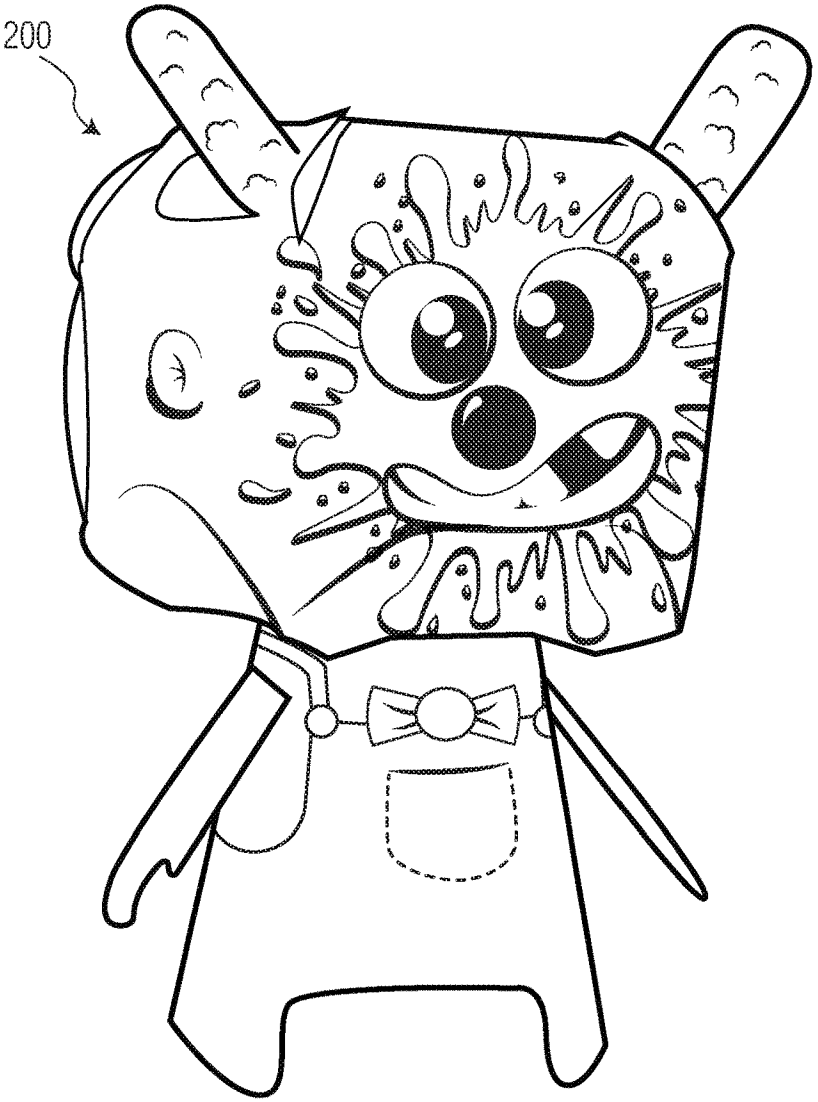

FIGS. 8A-8C are illustrations of a craft model bearing another design. Specifically, FIG. 8A shows a body cutout 12 and a head cutout 14 of the craft model design, FIG. 8B shows a front perspective view of the assembled three-dimensional craft model 200 formed by the body cutout 12 and the head cutout 14, and FIG. 8C shows a rear perspective view of the assembled three-dimensional craft model 200.

Figure 9A:
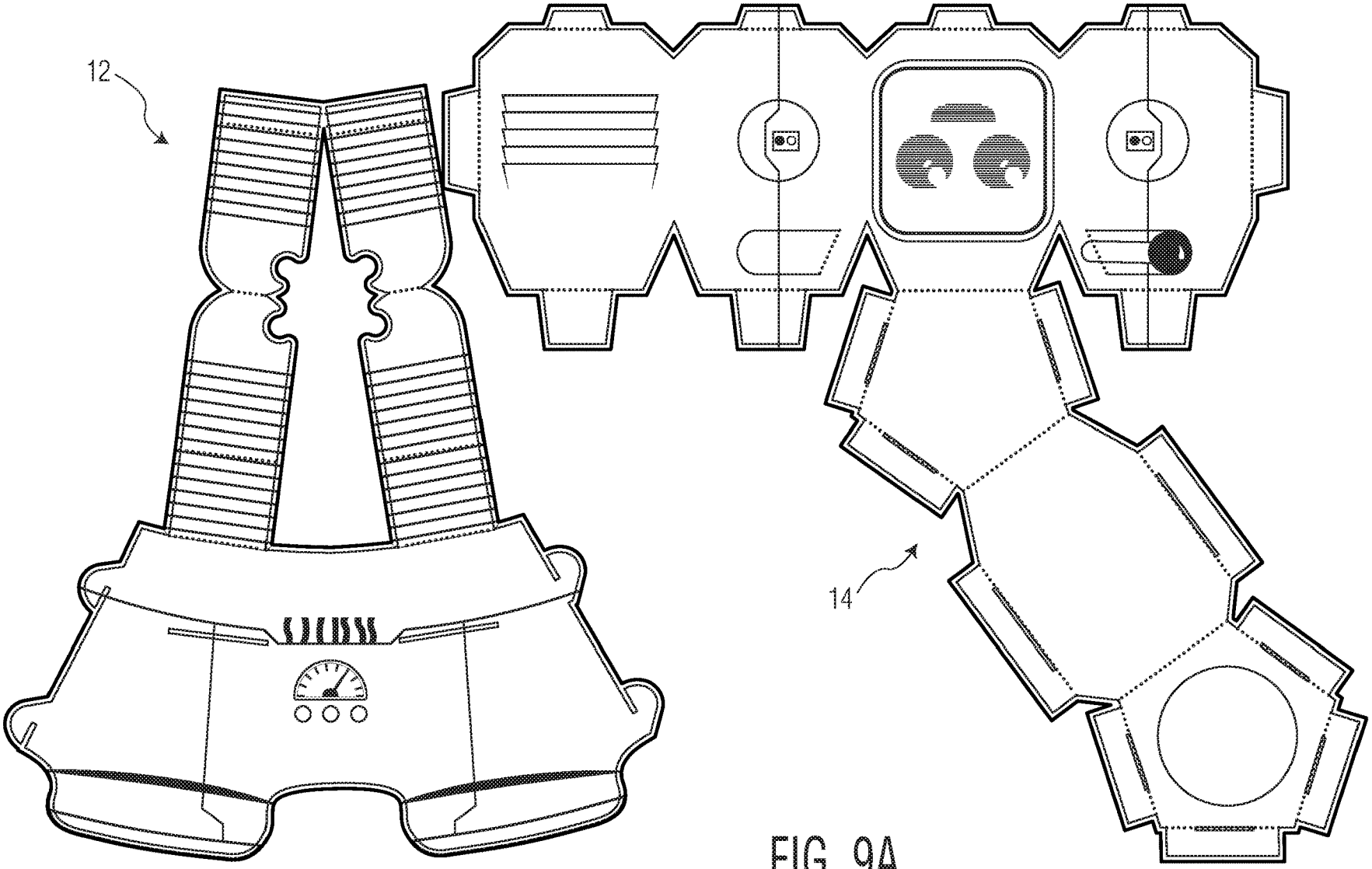
Figure 9C:
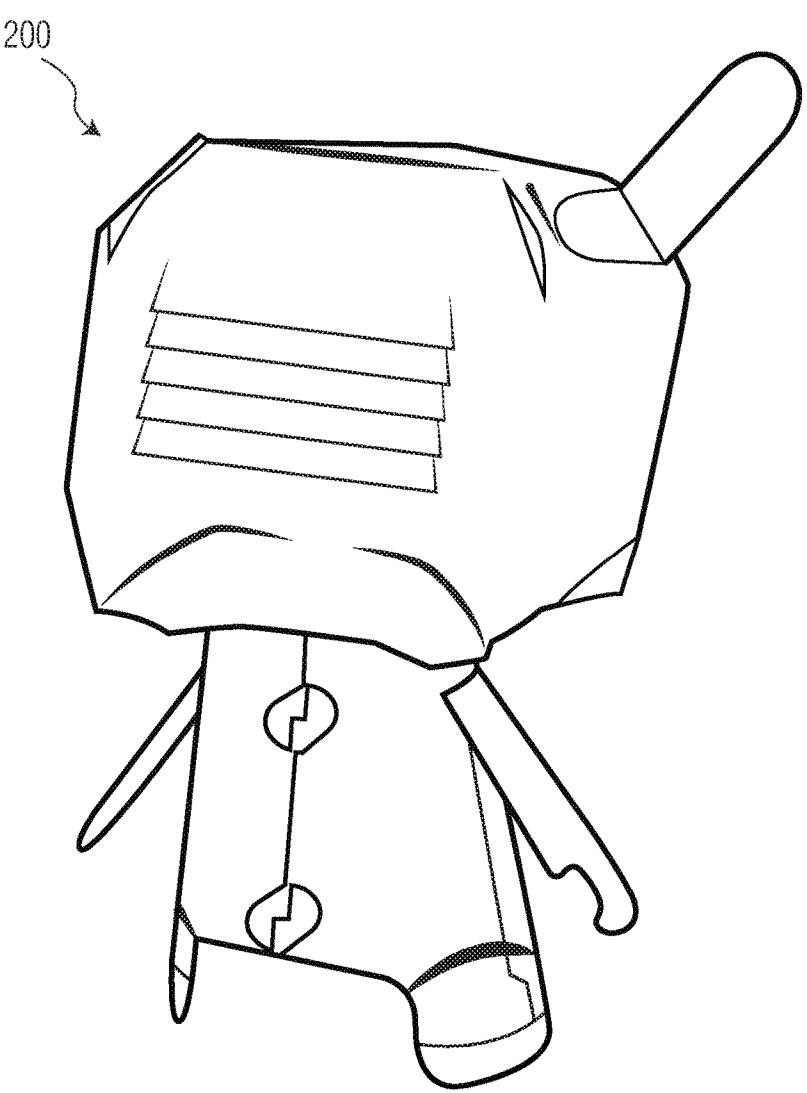
Figure 9B:
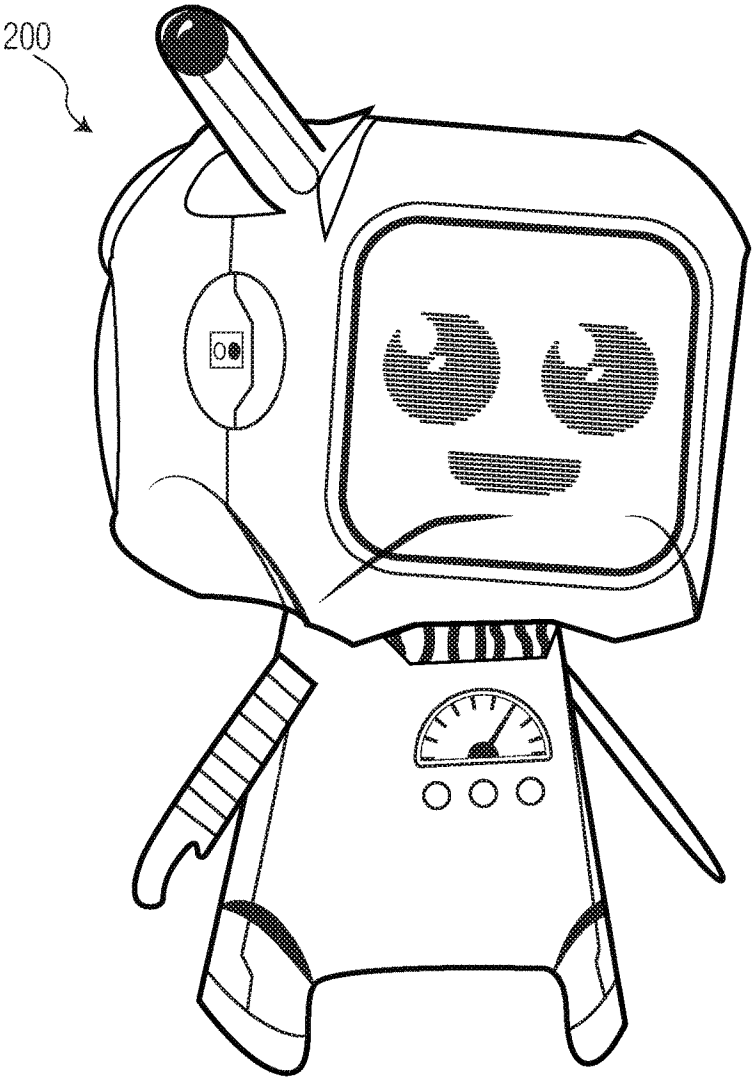

FIGS. 9A-9C are illustrations of a craft model bearing another design. Specifically, FIG. 9A shows a body cutout 12 and a head cutout 14 of the craft model design, FIG. 9B shows a front perspective view of the assembled three-dimensional craft model 200 formed by the body cutout 12 and the head cutout 14, and FIG. 9C shows a rear perspective view of the assembled three-dimensional craft model 200.

Having thus described the system and method in detail, it is to be understood that the foregoing description is not intended to limit the spirit or scope thereof. It will be understood that the embodiments of the present disclosure described herein are merely exemplary and that a person skilled in the art may make any variations and modification without departing from the spirit and scope of the disclosure. All such variations and modifications, including those discussed above, are intended to be included within the scope of the disclosure.

What is claimed is:

1. A craft model comprising:

a sheet having a body cutout and a head cutout;

a plurality of fold lines in the body cutout along which the body cutout is folded and a plurality of locking tabs in the body cutout configured to assemble the body cutout into a three-dimensional body object having a frustoconical shape and a circular upper edge;

a plurality of fold lines in the head cutout along which the head cutout is folded and a plurality of securing tabs and cooperating slots in the head cutout configured to assemble the head cutout into a three-dimensional head object having a plurality of surfaces including five equally sized, vertical surfaces; and a circular body attachment aperture in one of the plurality of surfaces of the head object, the head object receiving the circular upper edge of the frustoconical-shaped body object in frictional engagement about the circumference of the body attachment aperture to form a craft model having a head and body.

2. The craft model of claim 1, further comprising die cut lines.

3. The craft model of claim 1, further comprising score lines.

4. The craft model of claim 1, further comprising perforations.

5. The craft model of claim 1, wherein the sheet comprises plastic.

6. The craft model of claim 1, wherein the head cutout includes one or more decorative tabs extending at an angle from the head cutout.

7. The craft model of claim 1, wherein the head cutout includes one or more ear tabs extending at an angle from the head cutout.

8. The craft model of claim 1, wherein the head cutout includes a first side panel, a top panel, a second side panel, and a bottom panel including the circular body attachment aperture, wherein the first side panel is connected to the top panel, the top panel is connected to the second side panel, and the second side panel is connected to the bottom panel, and wherein the first and second side panels form a portion of a perimeter of the head object.

9. The craft model of claim 8, wherein the locking tabs each comprise a semi-circular tab that that is partially detached from the body cutout.

10. The craft model of claim 1, wherein the head object is attached to the body object by a pressure fit.

11. The craft model of claim 1, wherein the plurality of surfaces of the head object include first, second, third, fourth, and fifth side wall panels, and the head object further includes a top wall and a bottom wall, the bottom wall including the circular body attachment aperture.

12. A method of forming a three-dimensional craft model, comprising the steps of:

folding one or more portions of a body cutout across fold lines;

inserting the one or more folded portions through corresponding slots in the body cutout;

locking one or more locking tabs on the body cutout to form a three-dimensional body object having a frustoconical shape with a circular upper edge;

folding one or more portions of a head cutout across fold lines;

inserting one or more securing tabs through corresponding slots in the head cutout to form a three-dimensional head object having a plurality of surfaces including five equally sized, vertical surfaces; and attaching the three-dimensional head object to the three-dimensional body object by inserting the circular upper edge of the frustoconical body object in frictional engagement about the circumference of a circular body attachment aperture in one of the plurality of surfaces of the head object to form a three-dimensional craft model.

13. The method of claim 12, wherein the step of folding one or more portions of the body cutout across fold lines includes folding first and second arm portions about a first fold line to form a first arm of the body object.

14. The method of claim 13, wherein the step of inserting the one or more folded portions through corresponding slots in the body cutout includes folding the first arm of the body object about a second fold line and inserting the first arm through the corresponding slot from an interior side of the body object to an exterior side of the body object.

15. The method of claim 14, wherein the step of locking one or more locking tabs on the body cutout to form a three-dimensional body object includes interlocking first and second locking tabs on opposing sides of the body cutout.

16. The method of claim 12, wherein the step of folding one or more portions of the head cutout across fold lines includes folding one or more side head portions about a first fold line, folding a top head portion about a second fold line, and folding a bottom head portion about a third fold line.

17. The method of claim 16, wherein the one or more securing tabs are joined to the one or more portions of the head cutout and including the step of folding the one or more securing tabs about fold lines between the one or more portions of the head cutout and the securing tabs.

18. The method of claim 12, wherein the step of attaching the three-dimensional head object to the three-dimensional body object includes receiving the body object in the body attachment aperture disposed in a bottom portion of the head object to form a three-dimensional craft model having a head and body.

19. The method of claim 12, comprising the step of removing the body cutout and the head cutout from a sheet.

20. The method of claim 12, comprising the step of bending a decorative tab away from the head cutout such that the decorative tab extends from the head cutout at an angle.

21. The method of claim 12, comprising the step of bending an ear tab away from the head cutout such that the ear tab extends from the head cutout at an angle.

* * * * *